US011454229B1

(12) United States Patent
Corl et al.

(10) Patent No.: US 11,454,229 B1
(45) Date of Patent: Sep. 27, 2022

(54) DEWAR VACUUM MAINTENANCE SYSTEMS FOR INTERMITTENTLY POWERED SENSORS

(71) Applicant: Wavefront Research, Inc., Northampton, PA (US)

(72) Inventors: Jonas D. Corl, Bethlehem, PA (US); Randall C. Veitch, Walnutport, PA (US)

(73) Assignee: Wavefront Research, Inc., Northhampton, PA (US)

( * ) Notice: Subject to any disclaimer, the term of this patent is extended or adjusted under 35 U.S.C. 154(b) by 0 days.

(21) Appl. No.: 17/023,197

(22) Filed: Sep. 16, 2020

Related U.S. Application Data

(60) Provisional application No. 62/901,001, filed on Sep. 16, 2019.

(51) Int. Cl.
*F04B 37/14* (2006.01)
*F04B 49/06* (2006.01)
*H01J 41/12* (2006.01)

(52) U.S. Cl.
CPC ..... *F04B 37/14* (2013.01); *F04B 49/06* (2013.01); *H01J 41/12* (2013.01)

(58) Field of Classification Search
CPC ..... F04N 37/02; F04N 37/14; F04N 49/06; H01J 41/12
See application file for complete search history.

(56) References Cited

U.S. PATENT DOCUMENTS 6,241,477 B1 * 6/2001 Brezoczky ..... C23C 14/564 417/48
7,413,412 B2 * 8/2008 Govyandinov ..... F04B 19/006 417/48
8,287,247 B2 10/2012 Bonucci
8,342,813 B2 1/2013 Ferris
8,686,380 B2 * 4/2014 Katagiri ..... H01J 37/18 250/492.3

* cited by examiner

*Primary Examiner* — Patrick Hamo
(74) *Attorney, Agent, or Firm* — Culhane Meadows PLLC; Orlando Lopez

(57) ABSTRACT

Systems and methods that maintain a vacuum for a long period of time in a portable vacuum chamber are disclosed. Systems and methods for the maintenance of a vacuum in cryogenic Dewars for imaging systems with high gas loads using an integral pump and getter are also disclosed.

4 Claims, 5 Drawing Sheets

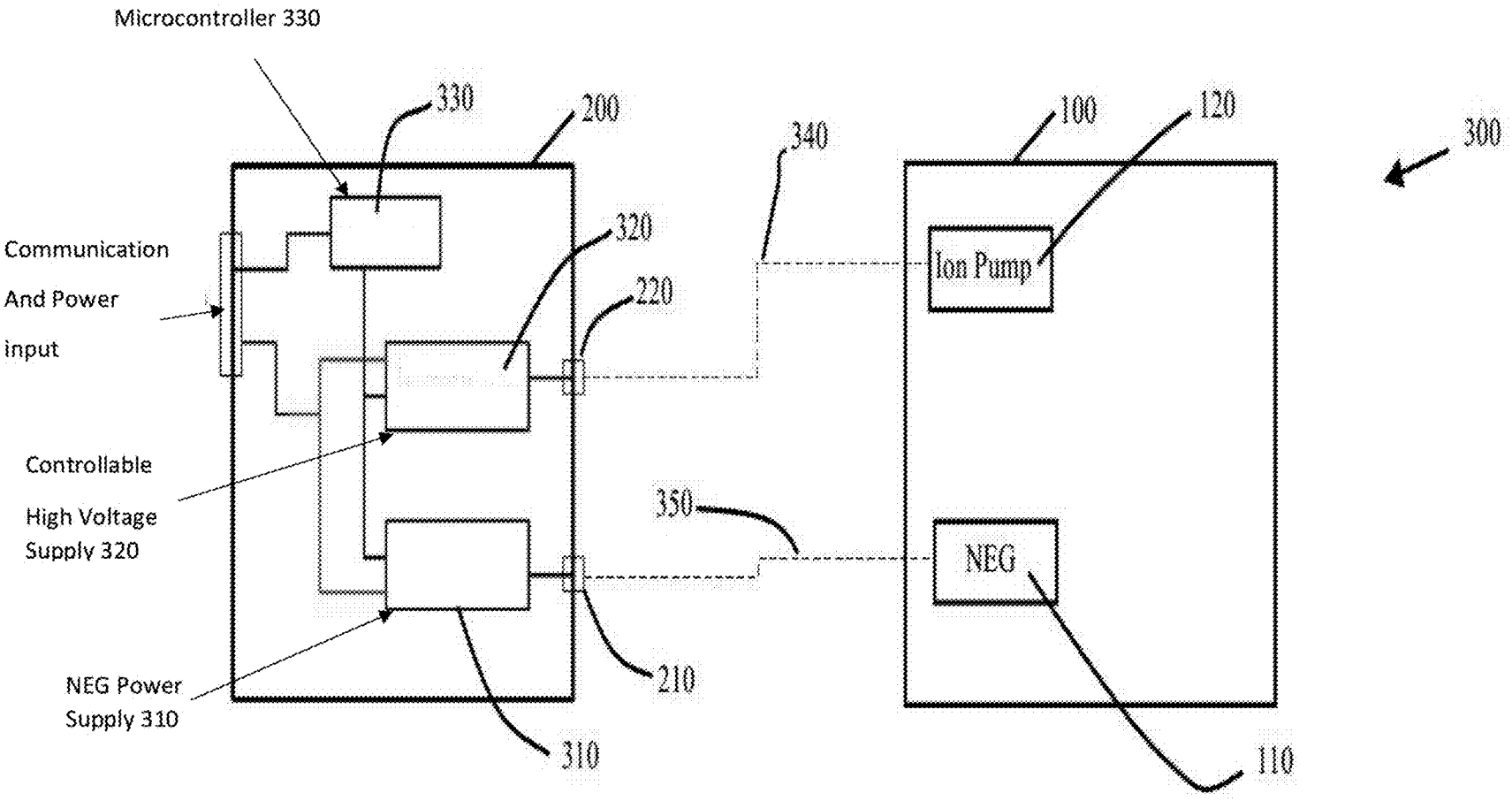
Figure 3: Dewar Vacuum Maintenance System Block Diagram

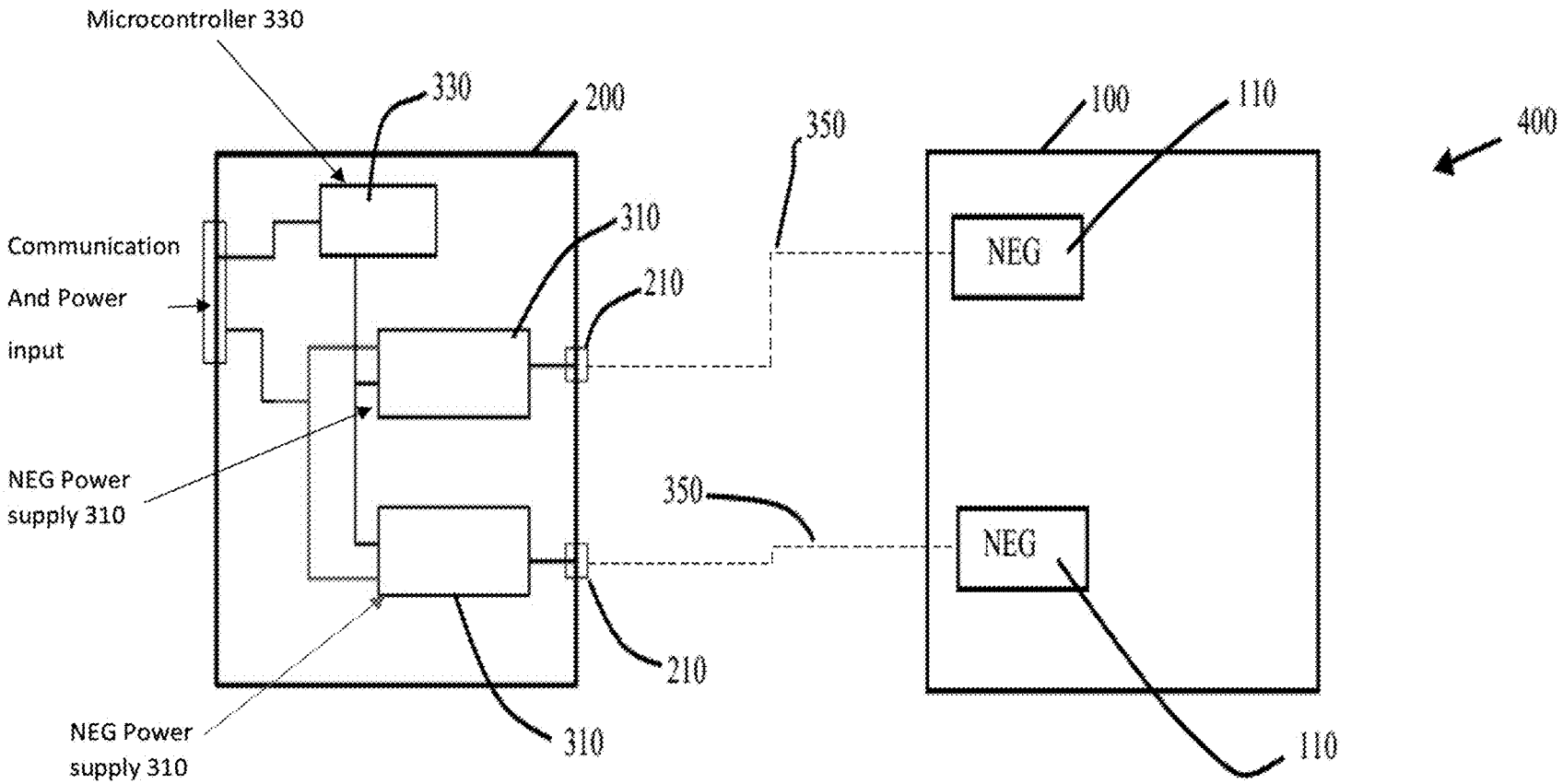
Figure 4: Alternate Dewar Vacuum Maintenance System Block Diagram

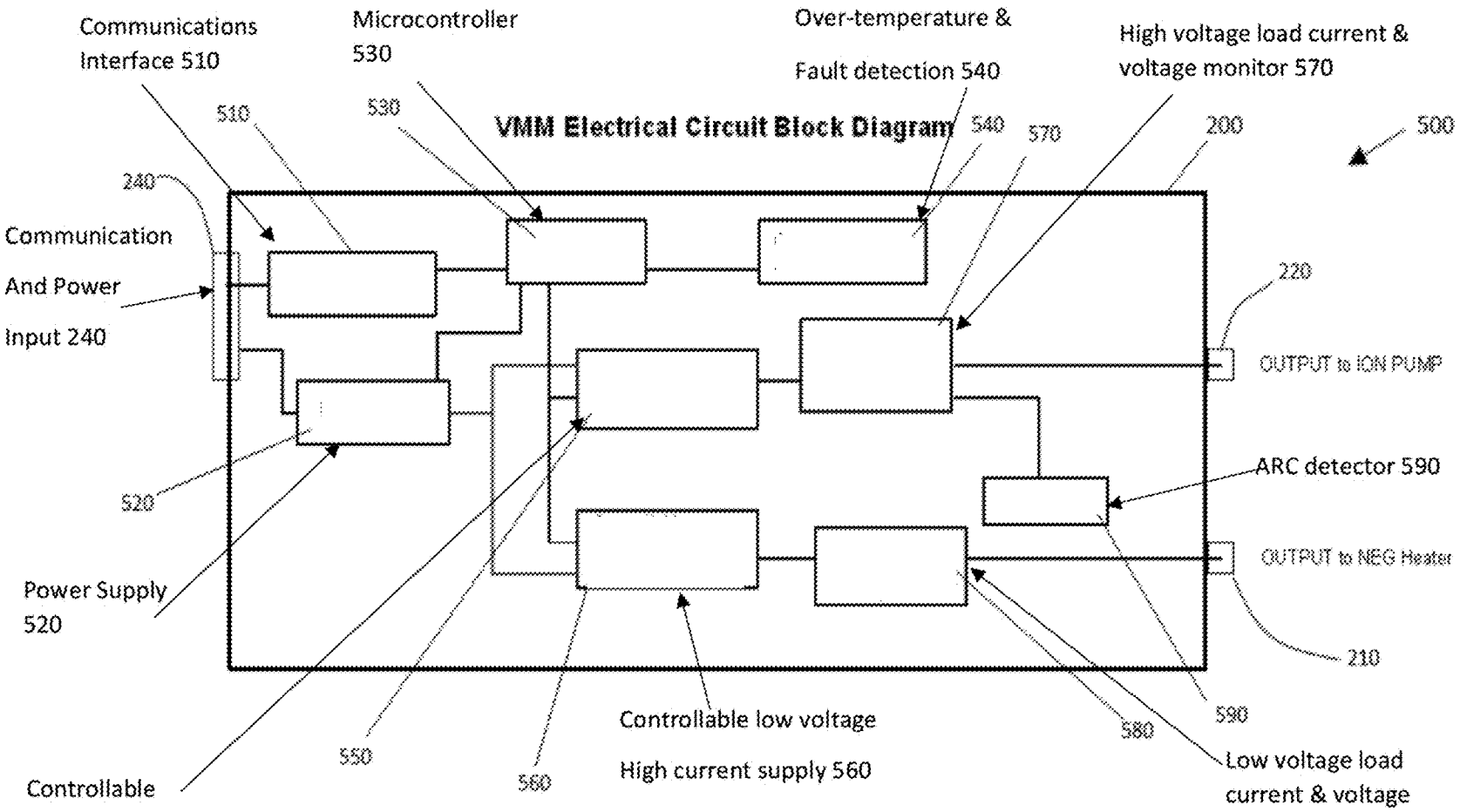
Figure 5: Detailed VMM Electrical Circuit Block Diagram

DEWAR VACUUM MAINTENANCE SYSTEMS FOR INTERMITTENTLY POWERED SENSORS

CROSS-REFERENCE TO RELATED APPLICATIONS

This application claims priority to U.S. Provisional Patent Application No. 62/901,001, filed on Sep. 16, 2019, entitled DEWAR VACUUM MAINTENANCE SYSTEMS FOR INTERMITTENTLY POWERED SENSORS, which is incorporated by reference herein in its entirety for all purposes.

STATEMENT OF GOVERNMENT INTEREST

This invention was made with U.S. Government support from the U.S. Army under contract W909MY-12-D-0008/0012 subcontract PO 22713; and under contract W909MY-17-C-0018. The U.S. Government has certain rights in the invention

BACKGROUND

These teachings relate generally to maintaining a vacuum for a long period of time in a portable vacuum chamber and more particularly to the maintenance of a vacuum in cryogenic Dewars for imaging systems with high gas loads using an integral pump and getter.

Certain process, operational, or design constraints can increase the gas load in a vacuum system beyond the capacity of a vacuum getter alone to maintain the desired vacuum levels for the operability of the system. Over time, the getter will begin to saturate and lose effectiveness, allowing the pressure in the system to increase. For example, the ability to dismantle a vacuum Dewar to modify or access internal components can be a desired feature in some system designs. This is typically accomplished through the use of disposable or reusable seals and sealing surfaces. For example, a Dewar may be sealed with O-rings, C-seals, or crushed metal or elastomer seals. When compared to a welded or soldered Dewar, these extra seal joints create an additional gas load that will reduce the length of time that the vacuum pressure is low enough to provide sufficient insulation.

Another example is a vacuum system that cannot be baked out. In this case, the residual desorption of water vapor and other gases from surfaces within the vacuum can overwhelm any gettering device to saturation; vacuum degradation results.

Yet another case is where the gas load of non-getterable species is sufficient to degrade the vacuum quality beyond operability. One case among many where this could happen is when the ingress of a noble gas is not removed by a reactive getter (e.g., a non-evaporable getter (NEG)) or pump (e.g., a titanium sublimation pump) and the noble gas accumulates over time, degrading vacuum quality.

Moreover, while an integral vacuum pump, such as, but not limited to, an ion pump, turbomolecular pump, diaphragm pump, scroll pump, or diffusion pump, may be able to pump all species of gases and thereby supplement the getter, it is often desirable that a system can remain unpowered but maintain sufficient vacuum quality for longer periods than would be possible without having any pumping or gettering. For example, a system may need to be stored or transported and still maintain sufficient vacuum quality for operation or startup. A battery solution to maintain power during storage or transport is an option but adds additional weight and complexity. Ideally, the use of a getter extends the unpowered operational lifetime of the vacuum to the desired duration.

Finally, when confronted with saturation of a getter, reactive, adsorptive, absorptive, or otherwise, it is desirable to be able to regenerate the getter without having to attach an external high vacuum pump to remove outgassed species from regenerating the getter. External pumping requires equipment non-integral to the system, the baking out of pumping lines, and additional skill and procedures to be put in place to ensure a good regeneration and purge. For fielded systems, attachment of an external pump can add extreme cost and operational delays.

There is a need for systems and methods that maintain a vacuum for a long period of time in a portable vacuum chamber. There is also a need for systems and methods for the maintenance of a vacuum in cryogenic Dewars for imaging systems with high gas loads using an integral pump and getter.

BRIEF SUMMARY

Systems and methods that maintain a vacuum for a long period of time in a portable vacuum chamber are disclosed. Systems and methods for the maintenance of a vacuum in cryogenic Dewars for imaging systems with high gas loads using an integral pump and getter are also disclosed 'For a better understanding of the present teachings, together with other and further needs thereof, reference is made to the accompanying drawings and detailed description.

BRIEF DESCRIPTION OF THE DRAWINGS

FIG. 3 shows a block diagram of an embodiment of the present teachings using an ion pump and NEG.

FIG. 4 shows a block diagram of an embodiment of the present teachings using two NEGs.

FIG. 5 shows a block diagram of a further embodiment of the present teachings.

DETAILED DESCRIPTION

The following detailed description presents the currently contemplated modes of carrying out the invention. The description is not to be taken in a limiting sense, but is made merely for the purpose of illustrating the general principles of the invention.

The present teachings, using a getter and integral pump, can enable a higher gas load vacuum system to be stored unpowered for a desired duration of time while maintaining sufficient vacuum levels for restarting any powered pumps and can allow for regeneration of any getters without the need for an external pumping apparatus, without the need for opening valves, and without the need for breaking any of the vacuum chamber seals. Moreover, if an integral controller is used, user error is minimized because the coordination and control of the getter and pump is managed within the local system controller, not by a user. A "getter," as used herein, is a deposit of reactive material that is placed inside a vacuum system.

Where others have used various combinations of pumps or pumps and getters in high vacuum and UHV systems, one embodiment of the present teachings uses two together to facilitate a compact Dewar system, specifically, a complex Dewar such as is used for a hyperspectral imaging sensor. The term "Dewar" in the present teaching is used generally to represent a vacuum vessel whose purpose is maintaining an insulating vacuum. "Cryogenic Dewar Assembly", "Dewar", and Integrated Dewar Cooler Assembly (IDCA) are used here interchangeably.

The present teachings combine multiple integral pumping mechanisms to enable the regeneration of the NEG without the need for a pumping mechanism external to the system.

While others have combined NEG's and ion pumps, for example, in one embodiment of the present teachings we use the ion pump and the NEG together to enable intermittent operation of the ion pump while allowing the sensor to be stored without power and thus maintain operability after storage for longer periods than would be possible with an unpowered ion pump or NEG alone.

In another embodiment of the present teachings, for example, at least two NEG's are used to maintain vacuum as described in the previously described embodiment. One NEG regenerates while the other sorbs evolved hydrogen from the regenerating NEG. Yet another embodiment of the present teachings incorporates an ion pump with at least two NEGs to handle the non-getterable species and thus extends system lifetime between connection to an external vacuum pump.

The objects set forth above as well as further and other objects and advantages of the present teachings are achieved by the embodiments of the present teachings described hereinbelow.

Figure 1:
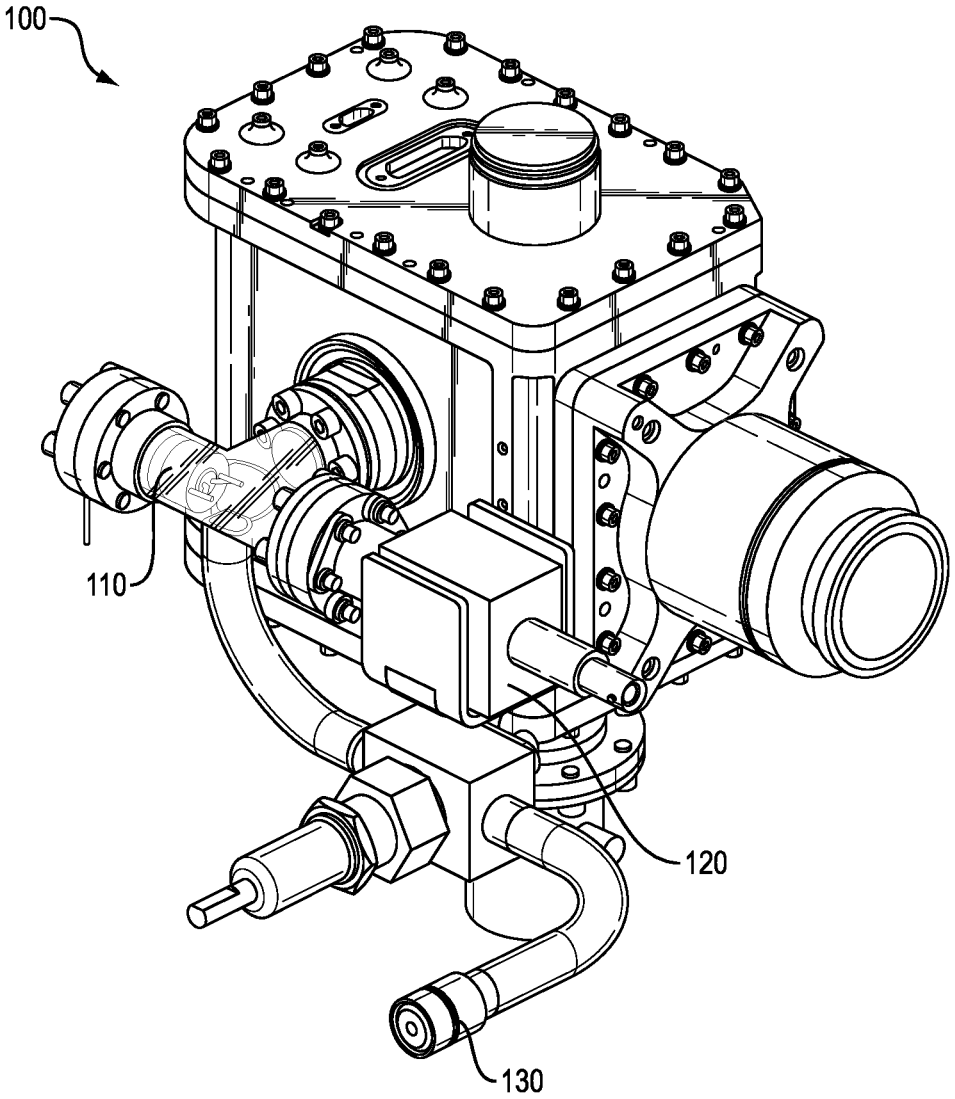
FIG. 1 shows a view of an embodiment of the present teachings in the context of a Dewar.

For a better understanding of the present teachings, together with other and further objects thereof, reference is made to FIG. 1, which shows an embodiment of Dewar vacuum maintenance with tandem pumping and gettering of the disclosed teachings in a cryogenic Dewar assembly 100. In this embodiment, the getter is a non-evaporable getter 110 and the pump is a compact noble diode ion pump 120. Some of the Dewar walls have been made transparent for viewing the NEG 110. The initial pumping of the IDCA 100 to high vacuum levels is performed by an external pump by means of the pump-out port 130. After initial pumping, the pump out port 130 can be sealed closed and any external vacuum pumping mechanism can be removed. The Vacuum Maintenance Module (VMM)) 200 shown in FIG. 2 contains power driver and controller circuitry for the NEG heater and ion pump for this and related embodiments of the present invention.

Figure 2:
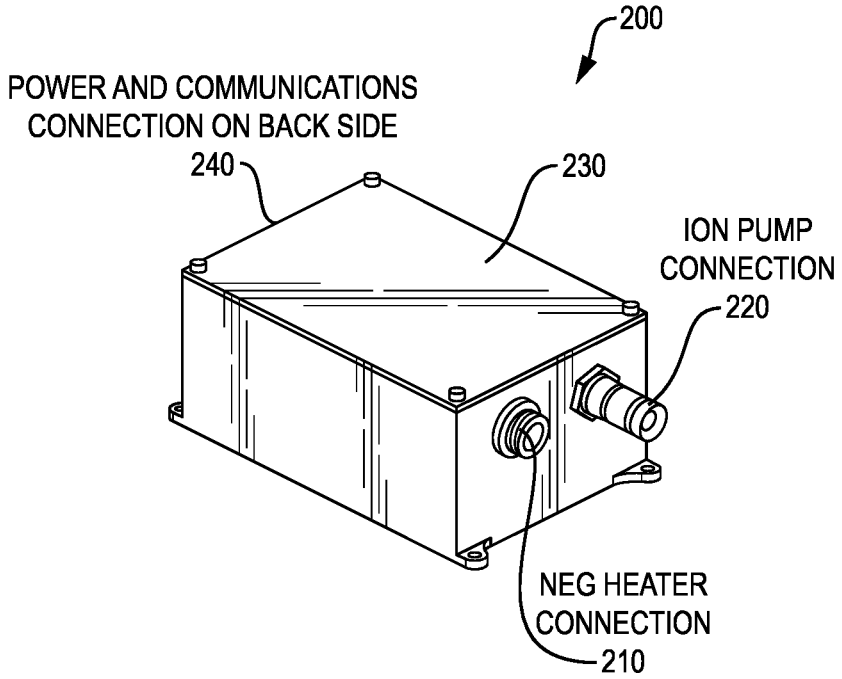
FIG. 2 shows a view of an embodiment of an integral pump and getter controller, the Vacuum Maintenance Module (VMM).

Referring to FIG. 2, the VMM 200 can contain both ion pump and non-evaporable getter (NEG) heater controllers or power supplies with optional intelligent control and optional monitoring of the vacuum. For example the VMM can be connected for interactive communications with a user or can operate as a stand-alone power supply for an ion pump.

For routine maintenance of a vacuum environment, the ion pump may be run only periodically (e.g. only at system startup) or continuously, depending on the system's vacuum leak rate and required vacuum levels.

In one configuration the VMM can contains a high current, low voltage power supply for powering a getter cartridge with an internal heater element. The VMM can be packaged to function safely at high altitudes and in vacuum environments and can be designed for operation over broad temperature ranges, such as from −40° C. to 50° C. environments. The VMM's high current, low voltage supply can be used to initialize an NEG getter mechanism while under external vacuum pumping. Also, the VMMC can have an auto-NEG firing mode for light maintenance of the vacuum system getter if it is deemed necessary. (This mode can be used to avoid the need to attach or connect an additional (external) vacuum pump.

In some embodiments of the VMM the user can have access to vacuum system information via a TTL serial digital interface connection for communications. For VMMC use without a serial connection, there can also be a signal output of a variable pulse rate that can be used as a relative pressure indicator.

In some VMM configurations user can monitor VMMC power consumption, ion pump voltage, ion pump current, estimated pressure, and unit temperature. The user also has flexibility to set operational limits for voltage and current to the ion pump. The estimated pressure can be determined from these other parameters as is common in the art.

Other configurations of the VMM also provide provides ion pump arc protection and limits ion pump current to safe levels under higher pressure conditions. If too many arc conditions occur, the VMMC can be configured to shut down.

In normal operation of this embodiment of the disclosed teachings, the VMM 200 provides power and control to the ion pump 120 via the ion pump connection 220. When the vacuum pressure is low enough and power is provided, the ion pump 120 powers on and reduces pressures of all active and noble gases from the Dewar 100 vacuum at various rates of pumping until a new, lower steady state pressure is achieved with the ion pump on. Depending on the desires of the user, the ion pump can be on periodically or can be normally on when power is available. The NEG 110 operates passively as a reactive getter.

Should the ion pump 120 not be able to operate because the pressure is too high, it is likely that either the NEG 110 is saturated and, therefore, unable to pump enough of the gas load inside the vacuum, or the noble gas partial pressure is too high, requiring the attachment of an external vacuum pump or the powering of the system cryocooler(s) to cryopump some of the internal gasses. Both of these scenarios are generally undesirable because of the required skill, associated costs, and operational delays. (The cryopumping method adds delays because of the time to cool down and warm up and might not even have enough capacity to reduce the pressure sufficiently and the external pump method requires the system to be accessed via maintenance ports, a vacuum line evacuated, the vacuum line baked out, and then the system evacuated, adding delays, as well.) The storage life of the system (the time with the ion pump 120 off) in this embodiment is set by the maximum starting pressure of the ion pump 120, the noble gas load, and the Dewar 100 vacuum volume. The NEG 110 is sized such that it doesn't begin to saturate during this storage life. Normal operation would require powering and operation of the ion pump 120 more frequently than the storage life of the system.

To prevent saturation of the NEG 110, and thus maintain the desired storage life, the controller 200 will regenerate the NEG periodically. This can be done as often as the user desires, but more frequently than the storage life period will ensure the storage lifetime of the Dewar 100 vacuum system is maintained. The controller can also use historical data on the length of time to reach steady state vacuum pressure during operation to infer the saturation level of the NEG.

Regardless of the trigger for regenerating the NEG 110 (user, time, system feedback, or other), once the ion pump 120 is operating, the controller 200 regenerates the NEG 110 by supplying current to the NEGheater. In this embodiment, the NEG 110 contains an internal heater, but in other embodiments the NEG can be externally heated. This heating is done with current sensing feedback from the ion pump 120. Reference is made to FIG. 3, where a block diagram 300 of this embodiment is shown. Inside the controller 200, a microcontroller 330 monitors the currents output by the controllable high voltage supply 320. The high voltage supply 320 is connected to the ion pump connection 220, which in turn is connected to the ion pump 120 by means of the connection 340. The connection 340 can be made directly or using an extending means, such as a cable, circuit board, or other method. Higher currents in the ion pump 120 correspond to higher pressures. Using the ion pump's 120 current feedback as a pressure sensor and the NEG 110 heater's current as a control variable, the microcontroller 330 within the controller 200 commands the NEG Power supply 310 to supply current through the NEG heater connection 210 to the NEG 110 by means of the NEG connection 350, controllably heating the NEG 110 while preventing the ion pump 120 from overloading (overloading happens when the pressure inside the vacuum vessel, or Dewar, is above the range over which the ion pump can operate). Just as the connection 340 can be direct or extended, so can the NEG connection 350. The NEG 110 is heated to regeneration temperature and held there for the required time for generation. After the required time for regeneration of the NEG 110 has passed, the ion pump 120 remains on until the NEG 110 has cooled.

This approach to pumping and gettering has the advantages of being compact, lightweight, integral, and automatic. Conventional regeneration of an NEG 110 requires the attachment of an external vacuum pump which is typically heavy and prone to user error. Moreover, the use of an integral ion pump 120 alone would provide good vacuum maintenance but would allow only minimal storage life of the Dewar 100 vacuum with the power to the ion pump 120 off, requiring the ion pump 120 to be plugged into an external power source such as a wall outlet or a battery pack during storage. The tandem use of the ion pump 120 and NEG 110 allows for longer storage life and regeneration of the NEG 110 without the need for external power during significant storage times or for external pumps (e.g., turbopumps) for the regeneration process. Additionally, the use of a combined controller 200 can close the loop on the NEG 110 regeneration process, thus reducing the risk for process error, and can maintain the vacuum of the Dewar assembly 100 within the total useful lifetimes of the NEG 110 and the ion pump 120.

Reference is made to FIG. 4, where in another embodiment 400 of the present teachings, for example, two or more NEGs 110 (or other getters) are used in tandem. During the regeneration of a NEG or other getter, the major evolved gas is hydrogen and a room temperature NEG has a very large hydrogen sorption capacity. Sizing the NEG's such that each NEG is capable of absorbing the entirety of the hydrogen load for the stand-alone lifetime of the system enables the two NEGs to be used to shuffle the sorbed hydrogen from one NEG to the other during firing. This has an advantage over using the ion pump for pressure reduction during regeneration because ion pumps are generally poor at pumping hydrogen, whereas the non-heated NEG is excellent at sorbing hydrogen. In this embodiment an ion pump such as, but not limited to, a noble diode ion pump, can be used if non-getterable species are considered to be a significant gas load for operability. Another embodiment uses the multiple NEGs without an ion pump because the non-getterable gas load has an insignificant impact on system performance, operability, life, or storage life.

FIG. 5 contains a schematic block diagram of a further embodiment 500 of the VMM. In this embodiment, digital communications and input power input 240 is shown. Also shown are an electrically isolated communications interface 510; power supply circuit, input current and voltage monitors and low voltage regulation 520; microcontroller 530 which manages and monitors all aspects of VMM subcircuits, interfaces to user communications, etc. and operates with on board firmware; circuit fault protections 540; microcontroller controlled, programmable high voltage power supply 550; microcontroller controlled, programmable high current, low voltage supply 560; high voltage output voltage and load current monitor circuit 570, which senses voltage and current supplied to the ion pump; high current supply, current and voltage monitor circuit 580, which senses voltage and current supplied to the NEG heater element; and ARC detection circuit for detection of arcing in the ion pump 590. Other optional direct wiring between the monitors and microcontroller are not shown.

Other embodiments of the disclosed teachings include, but are not limited to, using cryosorbs, other getters besides NEG's, absorptive getters, dessicators, or titanium sublimation pumps in the place of a getter and diaphragm pumps, turbo pumps, positive displacement pumps, or diffusion pumps in the place of the ion pump. The getter and pump may be placed in any convenient location where they are connected to the vacuum system to be maintained.

Although these teachings has been described with respect to various embodiments, it should be realized these teachings are also capable of a wide variety of further and other embodiments within the spirit and scope of these teachings

The invention claimed is:

1. A vacuum maintenance device comprising:
a first electrical power supply;
said first electrical power supply capable of supplying an ion pump with electrical power for operation;
a second electrical power supply;
said second electrical power supply capable of supplying electrical power for thermally regenerate the getter in a getter pump;
thermal regeneration producing released gasses;
control circuitry;
said control circuitry capable of controlling said second electrical power supply producing a controlled rate of said released gasses;
said controlled rate of said released gasses enabling the ion pump to remove at least a portion of said released gasses without the need to connect to an auxiliary vacuum pump during thermally regenerating the getter.

2. The vacuum maintenance device of claim 1 wherein said control circuitry is a controller.

3. The vacuum maintenance device of claim 2 further comprising a communications interface operatively connected to the controller.

4. The vacuum maintenance device of claim 2 wherein the controller is operatively connected to the first electrical power supply and receives data describing current supplied to the ion pump; wherein the controller also uses the data describing the current supplied to the ion pump to determine the electrical power for thermally regenerating the getter.

* * * * *